US009574375B2

(12) United States Patent
Henderson

(10) Patent No.: US 9,574,375 B2
(45) Date of Patent: Feb. 21, 2017

(54) ELECTRONIC LOCK

(71) Applicant: Kevin Henderson, Davenport, FL (US)

(72) Inventor: Kevin Henderson, Davenport, FL (US)

( * ) Notice: Subject to any disclaimer, the term of this patent is extended or adjusted under 35 U.S.C. 154(b) by 66 days.

(21) Appl. No.: 14/587,437

(22) Filed: Dec. 31, 2014

(65) Prior Publication Data

US 2016/0133071 A1 May 12, 2016

Related U.S. Application Data

(60) Provisional application No. 62/076,988, filed on Nov. 7, 2014.

(51) Int. Cl.
*E05B 47/00* (2006.01)
*G07C 9/00* (2006.01)

(52) U.S. Cl.
CPC ..... *E05B 47/0001* (2013.01); *G07C 9/0069* (2013.01); *G07C 9/00563* (2013.01); *G07C 2009/00373* (2013.01); *G07C 2009/00642* (2013.01)

(58) Field of Classification Search
CPC ..... G07C 2009/00634; G07C 2009/00642; G07C 9/0073; G07C 9/00714; G07C 9/00674; G07C 2009/0065; G07C 2009/00619; G07C 9/00563; G07C 9/0069; G07C 2009/0373; E05B 47/0001; E05B 47/0012; E05B 47/00; E05B 2047/0048; E05B 2047/0057; E05B 2047/0073; E05B 2047/0076
USPC ..... 340/4.42
See application file for complete search history.

(56) References Cited

U.S. PATENT DOCUMENTS 5,493,279 A * 2/1996 Dawson ..... E05B 39/00 340/5.32
5,896,026 A * 4/1999 Higgins ..... G07C 9/00896 320/166
7,334,443 B2 * 2/2008 Meekma ..... E05B 47/0673 307/10.2
7,734,068 B2 * 6/2010 Fisher ..... E05B 19/0005 382/115
7,908,896 B1 * 3/2011 Olson ..... E05B 47/068 340/5.2
8,079,240 B2 * 12/2011 Brown ..... E05B 47/00 340/5.64
8,354,914 B2 * 1/2013 Buckingham ..... E05B 47/00 340/5.6
8,593,252 B2 * 11/2013 Fisher ..... G07C 9/00571 235/382

(Continued)

*Primary Examiner* — Brian Miller
(74) *Attorney, Agent, or Firm* — Michael Best & Friedrich LLP

(57) ABSTRACT

An electronic lock includes a lock mechanism, an actuator coupled to the lock mechanism and configured to lock and release the lock mechanism, and an actuator control circuit coupled to the actuator. The electronic lock also includes a battery electrically coupled to the actuator, a super capacitor electrically coupled to the battery, and a processor coupled to the actuator, the battery, and the super capacitor. The processor is configured to selectively receive power from the battery and the super capacitor, wherein the processor receives power from the super capacitor when a state of charge of the battery is below a predetermined voltage threshold, and provide control signals to the actuator control circuit to control operation of the actuator.

19 Claims, 10 Drawing Sheets

(56) References Cited

U.S. PATENT DOCUMENTS

| | | | | |
|---|---|---|---|---|
| 8,772,970 | B2 * | 7/2014 | Lambrou | E05B 47/02 307/104 |
| 8,912,884 | B2 * | 12/2014 | Fisher | G07C 9/00571 235/382 |
| 8,922,333 | B1 * | 12/2014 | Kirkjan | G07C 9/00182 235/376 |
| 9,024,759 | B2 * | 5/2015 | Uyeda | E05B 47/00 340/10.4 |
| 9,235,942 | B2 * | 1/2016 | Chen | G07C 9/00174 |
| 9,328,532 | B2 * | 5/2016 | Nguyen | H01M 10/425 |
| 2004/0061343 | A1 * | 4/2004 | Bashford | E05B 47/0047 292/341.16 |
| 2007/0176491 | A1 * | 8/2007 | Kang | G07C 9/00182 307/10.1 |
| 2007/0257772 | A1 * | 11/2007 | Marcelle | A47G 29/1209 340/5.64 |
| 2008/0256999 | A1 * | 10/2008 | Hapke | D06F 37/42 70/283 |
| 2010/0031714 | A1 * | 2/2010 | Brown | E05B 47/00 70/91 |
| 2011/0289124 | A1 * | 11/2011 | Denison | G07F 11/002 707/812 |
| 2012/0169453 | A1 * | 7/2012 | Bryla | E05B 47/00 340/3.1 |
| 2013/0305353 | A1 * | 11/2013 | McMillan | G06F 21/31 726/19 |
| 2013/0335193 | A1 * | 12/2013 | Hanson | H04W 12/06 340/5.61 |
| 2014/0340032 | A1 * | 11/2014 | Curtis | H04B 5/0037 320/108 |
| 2015/0179011 | A1 * | 6/2015 | Kramer | G07C 9/00896 340/539.11 |

* cited by examiner

ELECTRONIC LOCK

BACKGROUND

The present invention relates to back-up power systems for consumer electronic devices and adaptive power-up sequences.

SUMMARY

Providing a reliable power supply on an electronic lock is important to provide the users with a reliable product. If the electronic lock is accidentally disconnected or if the power supply is interrupted, a user may find him/herself locked outside their house, for example, because their electronic lock does not have power. Therefore, the present invention provides a back-up power system used with an electronic lock, thereby making the electronic lock more reliable In some embodiments, the invention provides an electronic lock including a super capacitor to provide power to the control circuitry, for example a master board, of the electronic lock. In some embodiments, the electronic lock triggers the super capacitor to charge when a battery voltage is below a predetermined voltage threshold. In some embodiments, the super capacitor is charged with at least some of the same batteries of the electronic lock. In some embodiments, the super capacitor provides power to the electronic lock for a predetermined period of time and only powers some components of the electronic lock.

In other embodiments, the invention provides a method of operating the electronic lock described above. In yet other embodiments, the invention provides a physical lock that automatically enters a monitoring state without any user input. In some embodiments, during the monitoring mode, the electronic lock powers the master board, the display board and the wireless communication board. In some embodiments, the physical lock can authenticate the user and enter a different mode that is not a monitoring mode.

In still other embodiments, the invention provides a physical lock that wakes up with an adaptive sequence based on a selected mode for the physical lock.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should also be noted that a number of hardware and software based devices, as well as a number of different structural components may be utilized to implement the invention. A number of hardware and software based devices, as well as a number of different structural components, may be used to implement the invention. In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that in at least one embodiment, the electronic based aspects of the invention may be implemented in software (e.g., stored on non-transitory computer-readable medium) executable by one or more processors. As such, it should be noted that a plurality of hardware and software based devices, as well as a plurality of different structural components, may be utilized to implement the invention. For example, "control units" and "controllers" described in the specification can include processing components, such as one or more processors, one or more memory modules including non-transitory computer-readable medium, one or more input/output interfaces, and various connections (e.g., a system bus) connecting the components.

Figure 1:
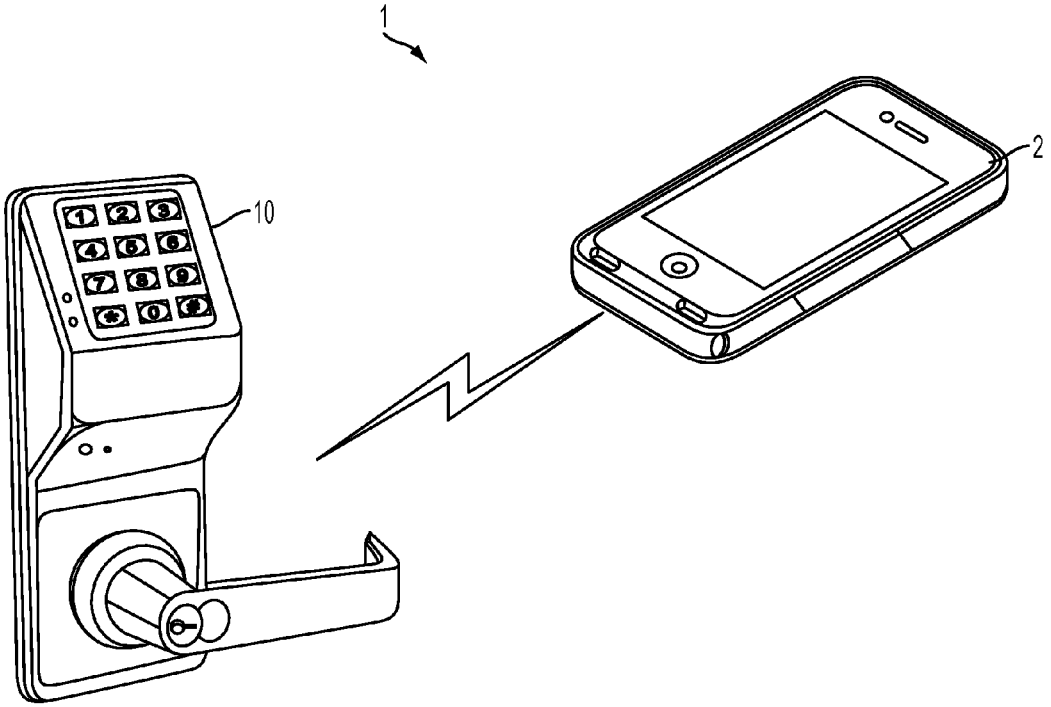
FIG. 1 illustrates an access system according to one embodiment of the invention.

FIG. 1 illustrates an access system 1. The access system 1 includes an external electronic device 2, and an electronic lock 10. The electronic lock 10 grants an authorized user access to a specified area such as, for example, a residence, a commercial building, a government building, a safe box, etc. The electronic lock 10 verifies that the user is an authorized user before providing access to the specified area. The electronic lock 10 is configured to authenticate the user in a variety of ways without the need for a physical key. For example, the electronic lock 10 communicates with the external electronic device 2 to authenticate a user through the external electronic device 2. The electronic lock 10 can also authenticate a user by requesting a secret code from the user. After validating the user, the electronic lock 10 opens and grants the authorized user access to the specified area.

Figure 2:
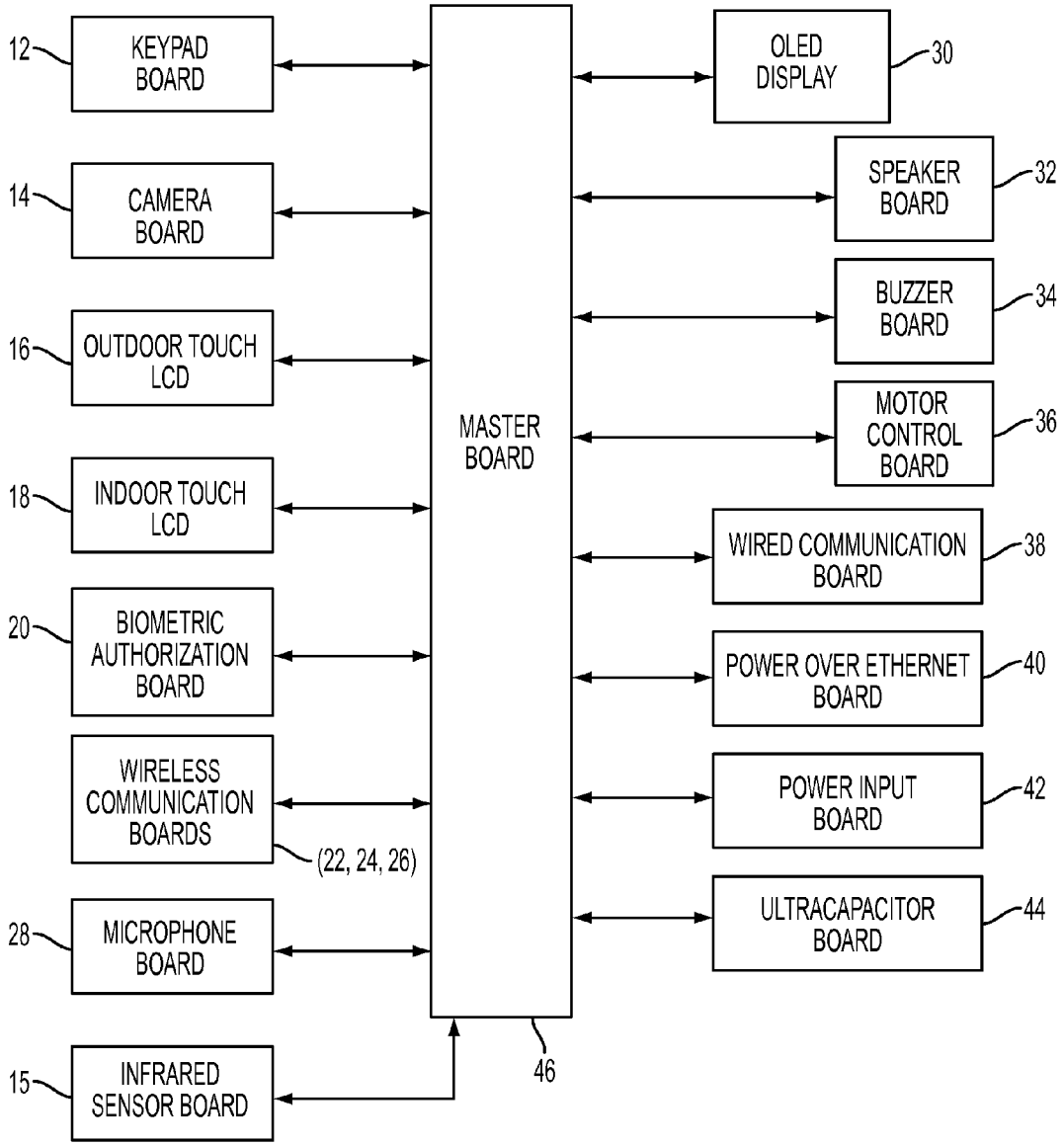
FIG. 2 is a schematic diagram of an electronic lock of the access system of FIG. 1.
Figure 3:
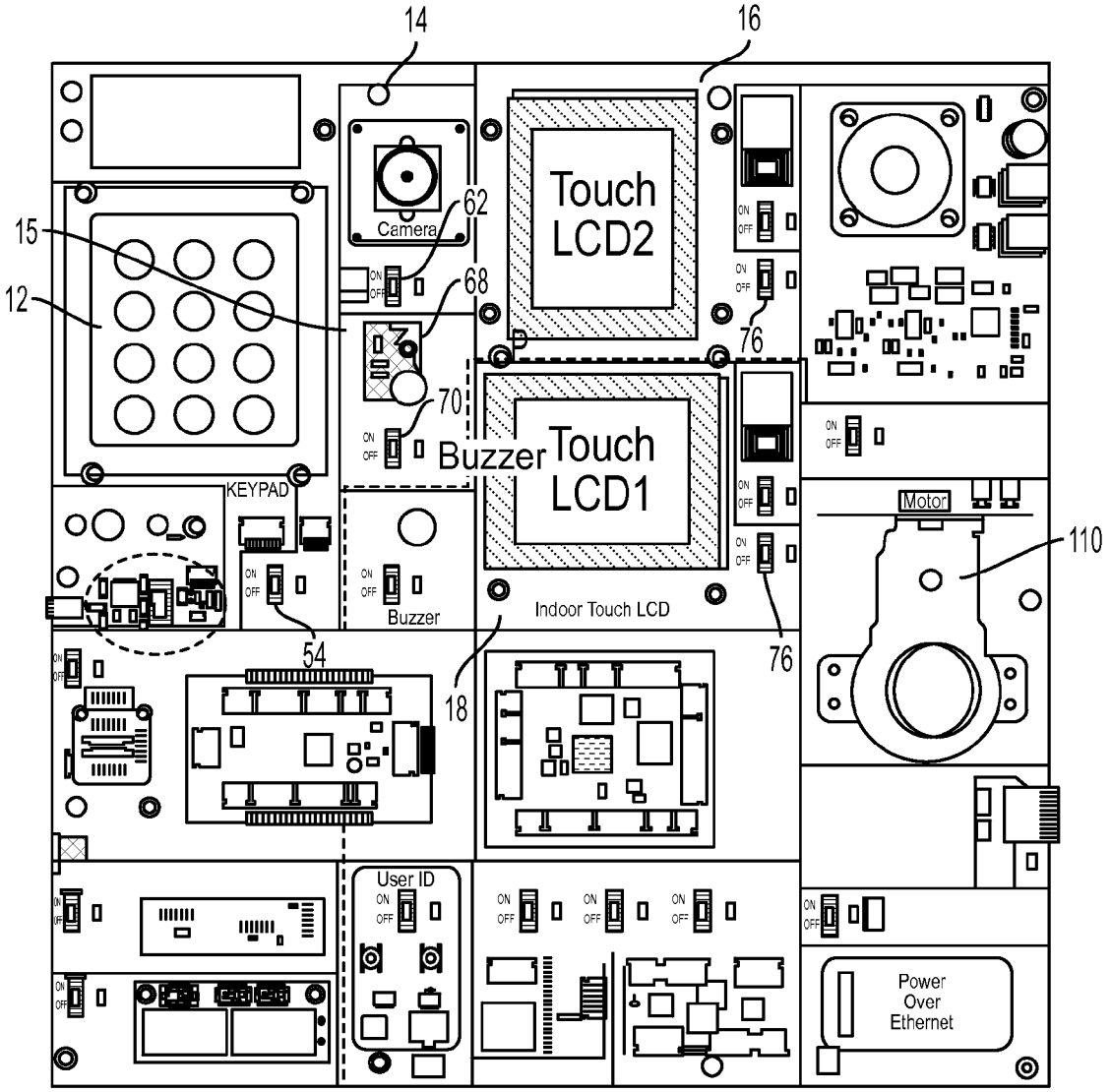
FIG. 3 illustrates a modular printed circuit board of the electronic lock.

FIG. 2 illustrates a schematic diagram of the electronic lock 10. As shown in FIG. 2, the electronic lock 10 includes a keypad board 12, a camera board 14, an infrared sensor board 15, an outdoor touch LCD board 16, an indoor touch LCD board 18, a biometric authorization board 20, a z-wave communication board 22, an internet communication board 24, a Bluetooth communication board 26, a microphone board 28, a display board 30, a speaker board 32, a buzzer board 34, a motor control board 36, a wired communication board 38, a power over internet board 40, a power input board 42, a super capacitor board 44, and a master board 46. In the illustrated embodiment, the various boards 12-46 described above are organized on a modular printed circuit board (PCB) 48, as shown in FIG. 3. The modular PCB 48 includes the master board 46 and secondary boards 12-44. Each secondary board 12-44 includes electrical and electronic components to perform a specific function or set of functions. Each secondary board 12-44 operates independently from each other and includes an independent connection to the master board 46. Therefore, if a secondary board 12-44 malfunctions, the rest of the secondary boards 12-44 continue to operate and the user experiences minimal disruption.

To operate independently some secondary boards 12-44 include a power switch. The power switch is switchable between an on position in which power is delivered to the secondary board 12-44 and an off position in which power is interrupted before being delivered to the secondary board 12-44. The master board 46 sends a control signal to the power switch indicating a position for the power switch. When the master board 46 determines that the secondary board 12-46 may be utilized by the user, the master board 46 sends a control signal (e.g., commands) to the power switch to be in the on position. The secondary board 12-44 then receives power and can perform its respective functionality.

While some secondary boards 12-44 may include the power switch described above, other secondary boards 12-44 include a microcontroller instead. The microcontroller controls other electronic components of the secondary board 12-44. The microcontroller communicates with the master board 46 and is configured to receive, via an input port, a signal from the master board 46 indicating whether the secondary board 12-44 should perform its respective functionality. The microcontroller then operates the electronic components of the secondary board 12-44 as necessary to perform the functionality associated with the secondary board 12-44. In some embodiments, some or all of the secondary boards 12-44 may include both the power switch and the microcontroller.

The master board 46 decides when to activate (e.g., power) each secondary board 12-44 based on operational modes for the electronic lock 10. In some embodiments, the master board 46 stores a configuration file that specifies which functionalities are desired by the user, which secondary boards 12-44 provide the desired functionality, and therefore, which secondary boards 12-44 are to be activated. Each configuration file may then be associated with each operational mode of the electronic lock 10, such that each mode includes a specific set of functionalities available to the user, and the master board 46 powers only the secondary boards 12-44 responsible for the desired functionality.

Figure 4:
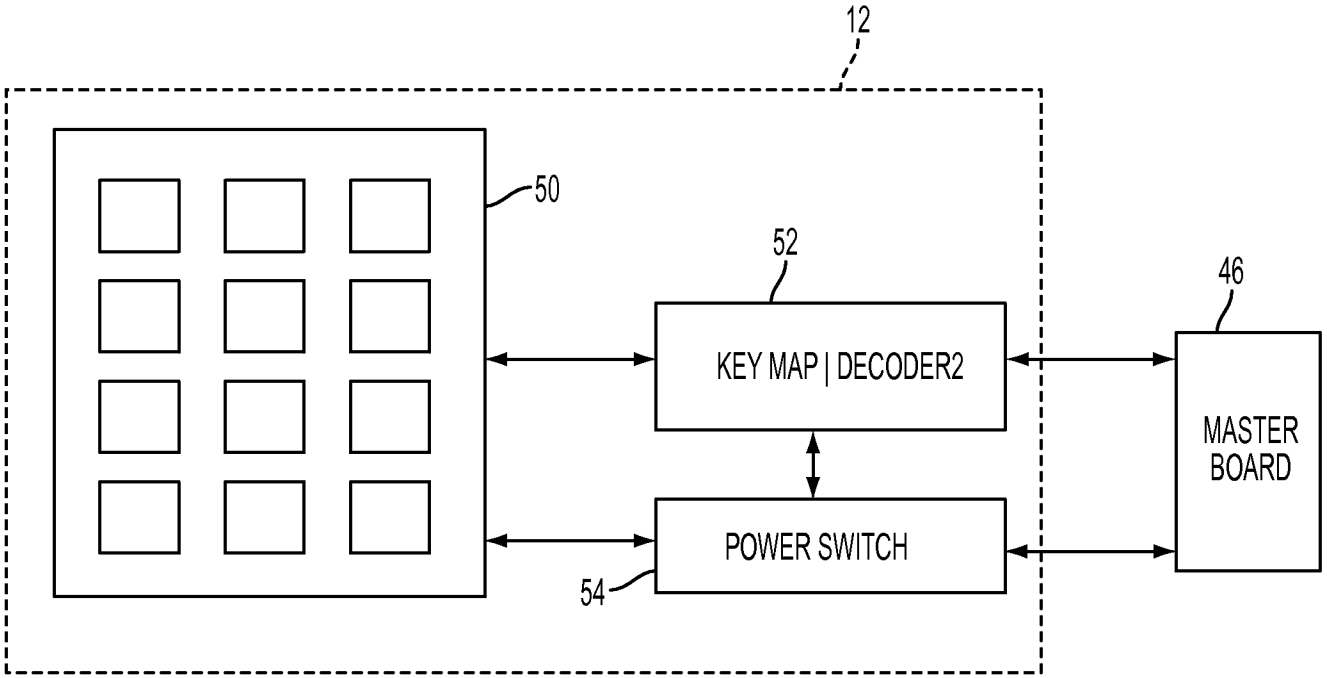
FIG. 4 is a schematic diagram of a keypad board.

As illustrated in FIG. 4, the keypad board 12 includes a physical keypad 50, a key map or decoder 52, and a power switch 54. The physical keypad 50 includes keys corresponding to alphanumeric characters. A user utilizes the keypad 50 to input an access code. The physical keypad 50 is electrically coupled to the decoder 52. The decoder 52 determines which key was pressed and what number and/or character was inputted by the user. In other words, the decoder 52 can distinguish between a user inputting a 3 or a user pressing the number 3 key to input an E. The decoder 52 is then electrically coupled to the master board 46 to communicate the inputted access code to the master board 46. The master board 46 then compares the inputted access code to a list of stored authorized access codes. If the access code inputted by the user matches one of the stored authorized access codes, the master board 46 operates the electronic lock 10 to grant user access to the restricted area. As shown in FIG. 4, the keypad board 12 also includes the power switch 54. The power switch 54 is coupled to the master board 46 to receive the control signal indicating when the keypad board 12 is to be activated. In the illustrated embodiment, the power switch 54 receives the control signal and the necessary power from the master board 46. In other embodiments, the power switch 54 is also coupled to a power supply board 40, 42, 44 to transfer power to the keypad 50 and the decoder 52.

Figure 5:
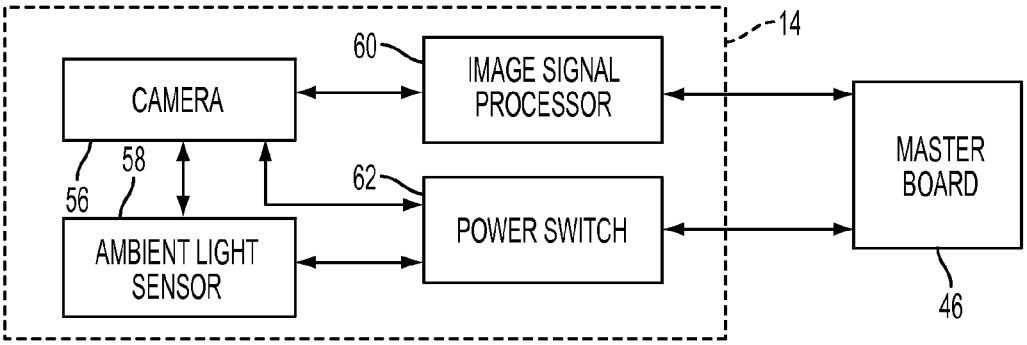
FIG. 5 is a schematic diagram of a camera board.

FIG. 5 illustrates the camera board 14 including a camera 56, an ambient light sensor 58, an image signal processor 60, and a power switch 62. The camera 56 may be a visible light camera or an infrared camera. In some embodiments, the camera 56 may have a separate housing than that of the electronic lock 10 and may be positioned separate from the electronic lock 10. Therefore, the camera 56 may be positioned to obtain the best angle of the entrance to the restricted area. For example, the camera 56 may be positioned above a door looking down to obtain a better view of the person at the door with the electronic lock 10. In the illustrated embodiment, the camera 56 is coupled to an ambient light sensor 58. The ambient light sensor 58 detects the amount of ambient light surrounding the camera 56. The camera 56 may then use the information from the ambient light sensor 58 to determine whether it would be better to capture visual light images or infrared images. For example, during the night, the ambient light sensor 58 may detect a low level of ambient light. The camera 56 may then appropriately obtain infrared images rather than visual light images.

The camera 56 is also coupled to the image signal processor 60. The image signal processor 60 receives visual signals from the camera 56 and generates a digital image based on the visual signals. In some embodiments, the image signal processor 60 may include a filter, or more, to enhance the image obtained by the camera 56. The camera 56 and the ambient light sensor 58 are coupled to the power switch 62. The power switch 62 is then coupled to the master board 46 to receive control signals indicating when the camera board 14 is to be powered. In some embodiments, the ambient light sensor 58 is coupled to the image signal processor 60 and the image signal processor 60 commands the camera 56 when to switch between capturing visual images and capturing infrared images based on the output from the ambient light sensor 58. In other embodiments, the ambient light sensor 58 is coupled directly to the master board 46, or is part of the master board 46, and the master board 46 sends a control signal to the camera board 14 indicating whether the camera 56 should capture visual light images or infrared images. In some embodiments, rather than having the camera 56 switch between capturing visual light images and capturing infrared images, the camera board 14 includes a visual light camera and an infrared camera. A control signal from the image signal processor 60 or the master board 46 indicates whether the visual light camera or the infrared camera should be activated. In some embodiments, both cameras may be activated and the camera board 14 may then obtain visual light and infrared images.

Figure 6:
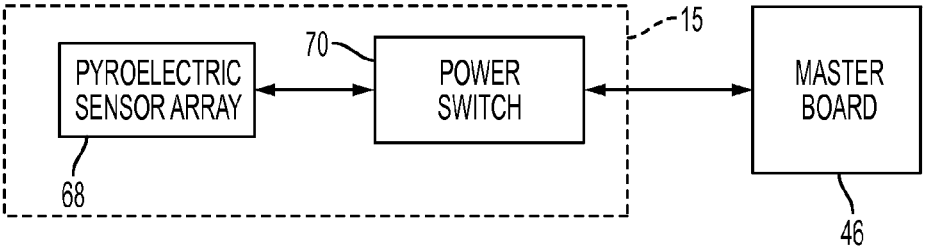
FIG. 6 is a schematic diagram of an infrared sensor board.
Figure 7:
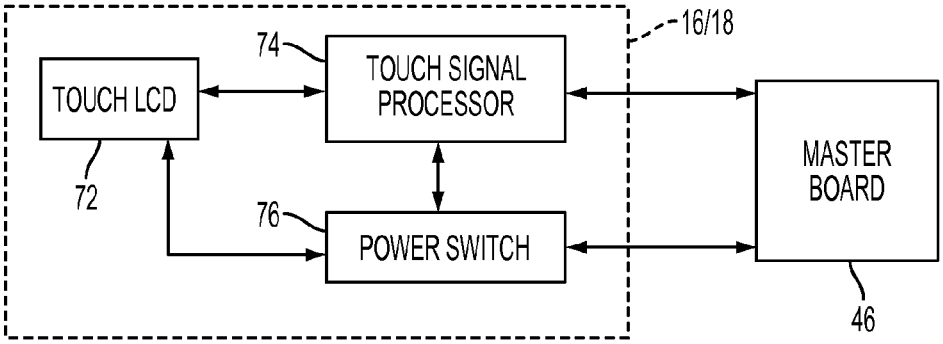
FIG. 7 is a schematic diagram of a touch LCD board.

As shown in FIG. 6, the infrared sensor board 15 includes an array of pyroelectric sensors 68 and a power switch 70. The sensor array 68 includes at least one, sometimes two, pyroelectric sensors, which are passive infrared detectors. The sensors are configured to detect infrared energy emitted by, for example, human bodies. In the illustrated embodiment, the sensor array 68 is specifically configured to detect a moving person nearby. The human body generally emits infrared energy of a wavelength between 9-10 micrometers. Therefore, the sensor array 8 includes sensors that are sensitive to infrared energy of a wavelength between 8-12 micrometers. In other embodiments, the sensor array 68 may be configured to detect other objects and may, therefore, use infrared sensors with different sensitivity. The sensor array 68 is coupled to the power switch 70. The power switch 70 is coupled to the master board 46 and determines when the infrared sensor board 15 is to be activated. When the infrared sensor board 15 is activated, the master board 46 receives signals and/or information from the infrared sensor board 15 regarding detected objects, in particular, detected human bodies. The master board 46 then uses the information received from the infrared sensor board 15 to control other secondary boards 12-44. For example, the master board 46 may determine when to activate the camera board 14 based on when the sensor array 68 detects a nearby object. The master board 46 can use the information from the infrared sensor board 15 to control and/or adapt the functionality of other secondary boards 12-44.

The indoor touch LCD board 16 and the outdoor touch LCD board 18 includes similar components, and are, therefore, described together herein and referred to collectively as the touch LCD boards 16, 18. The touch LCD boards 16, 18 include a touch-enabled LCD 72, a touch signal processor 74, and a power switch 76. In the illustrated embodiment, the touch LCD 72 includes a capacitive screen. In other words, in the illustrated embodiment, the touch LCD 72 includes a layer that stores electrical charge and that is below a glass panel of the LCD screen 72. When a finger comes close or touches the LCD screen 72, the amount of stored electrical charge changes. The LCD screen 72 also includes voltage measuring circuits positioned around the LCD screen 72, for example, one in each corner of the LCD screen 72. The LCD screen 72 is coupled to the touch signal processor 74. The touch signal processor 74 receives voltage measuring signals from the voltage measuring circuits positioned around the LCD screen 72. The touch signal processor 74 then uses the voltage measurements to determine where (e.g., map) the user touched the LCD screen 72. The touch signal processor 74 may then communicate with the master board 46 to relay information regarding where the user touched the LCD screen 72. The master board 46 may then communicate with the touch signal processor 74 to communicate what is displayed on the LCD screen 72. The power switch 76 is coupled to the touch LCD screen 72, the touch signal processor 74, and to the master board 46. The power switch 76 receives a control signal from the master board 46 to determine when the touch LCD boards 16, 18 is to be activated. The user may interact with the electronic lock 10 through the touch LCD boards 16, 18 to change settings and/or control functionality of the electronic lock 10 or to request an authentication action from the master board 46 to gain access to the restricted area. For example, the user may utilize the LCD screens 72 to replicate a pattern, to match specific pictures to each other, to input an access code. The master board 46 then performs an authentication action and compares the user's input to stored authorized actions and determines whether the user is an authorized user based on the comparison between the user's action and the stored actions.

Figure 8:
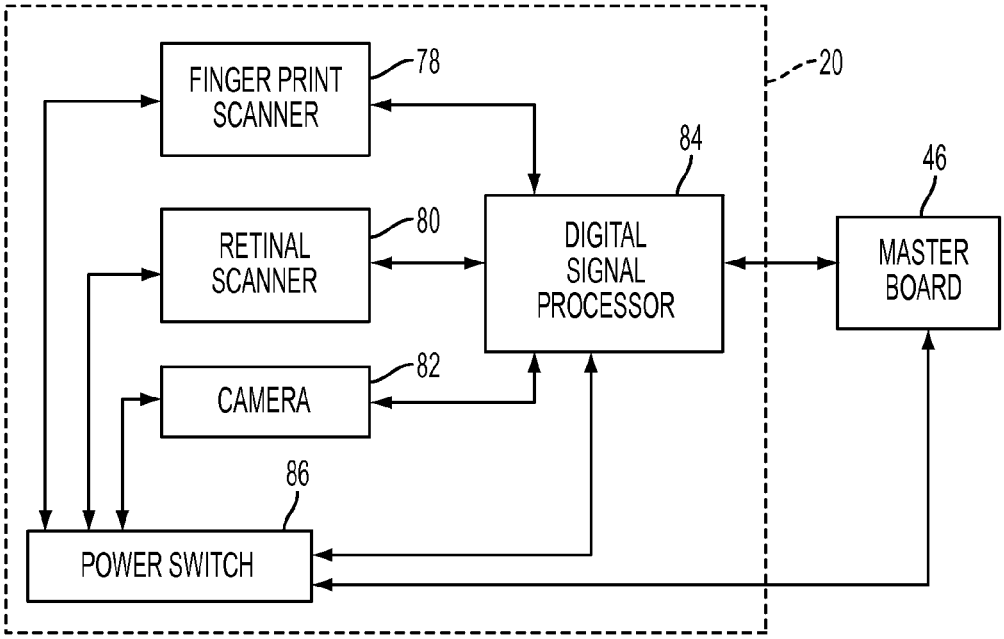
FIG. 8 is a schematic diagram of a biometric authorization board.

The user can also request an authentication action from the master board 46 through the biometric authorization board 20. As shown in FIG. 8, the biometric authorization board 20 includes a fingerprint scanner 78, a retinal scanner 80, a camera 82, a signal processor 84, and a power switch 86. In the illustrated embodiment, the fingerprint scanner 78 is an optical scanner that includes a charge coupled device (CCD) under a glass panel. The user positions his/her finger on the glass panel and the CCD captures an image of the user's fingerprint. The CCD then sends the captured image to the signal processor 84. The signal processor 84 determines whether the scan quality is sufficiently high to compare the fingerprint scan to a stored fingerprint scan, or, on the other hand, whether it would be beneficial to redo the scan. Once a good scan is obtained, the signal processor 84 transmits the fingerprint scan to the master board 46 for the master board 46 to perform an authentication action by comparing the obtained scanned with at least one stored fingerprint scan. If the obtained fingerprint scan matches at least one of the stored fingerprint scans, the master board 46 determines that the user is an authorized user. In other embodiments, the fingerprint scanner 78 may be a capacitive scanner including conductor plates that help the fingerprint scanner 78 develop a fingerprint image. Like the optical scanner described above, the capacitive scanner also transmits the obtained fingerprint image to the signal processor 84 and eventually to the master board 46 for the user to be authenticated.

The retinal scanner 80 includes an infrared emitter and an infrared detector. The infrared emitter directs infrared energy into the user's eyes while the infrared detector detects the amount of infrared energy reflected back from the user's eyes. The retinal scanner 80 then transmits the infrared energy information (e.g., data signals including infrared energy measurements) to the signal processor 84. The signal processor 84 then determines blood vessel patterns and sends the blood vessel pattern information to the master board 46. The master board 46 then performs an authentication action by comparing the blood vessel pattern obtained from the user to stored blood vessel patterns identifying authorized users. If the blood vessel pattern from the user matches at least one of the stored blood vessel patterns, the master board 46 determines that the user is an authorized user.

The camera 82 may be used by the biometric authorization board 20 to detect a person's face and determine, from that alone, who the person is, whether they feel ok, etc. In other embodiments, however, the camera board 14 performs this function and therefore, the camera 82 is not included in the biometric authorization board 20. In other embodiments, the biometric authorization board 20 also includes an iris scanner that obtains an image of a user's iris. The master board 46 can then compare the user's iris scan to stored iris scans for authorized users.

The power switch 86 of the biometric authorization board 20 is coupled to each of the fingerprint scanner 78, the retinal scanner 80, and the camera 82, the signal processor 84, and the master board 46. The power switch 86 receives a control signal from the master board 46 indicating when each of the scanners 78, 80, 82 is to be activated. The power switch 86 can turn one of the scanners 78, 80, 82 on, while the rest remained deactivated 78, 80, 82.

Figure 9:
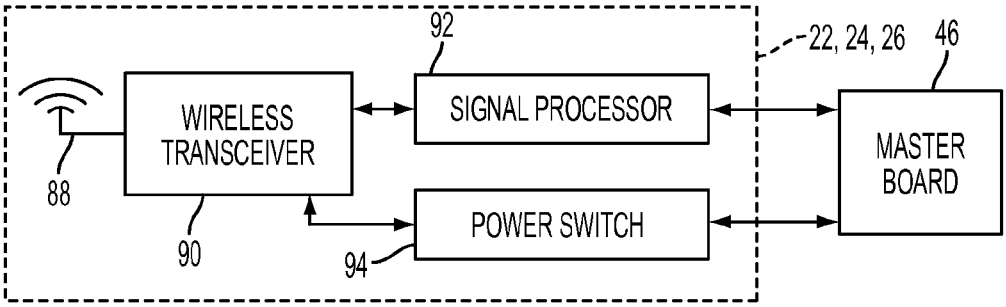
FIG. 9 is a schematic diagram of a wireless communication board.

The z-wave communication board 22, the internet communication board 24, and the Bluetooth communication board 26 all generally allow the electronic lock 10 to communicate wirelessly with other devices. These boards 22, 24, 26 also include similar components and are described together herein, and collectively called the communication boards 22-26. As shown in FIG. 9, the communication boards 22-26 include a wireless communication circuit having an antenna 88, a wireless transceiver 90, a signal processor 92, and a power switch 94. The antenna 88 is coupled to the wireless transceiver 90 and together the antenna 88 and the transceiver 90 work to detect and transmit wireless messages from other electronic devices (e.g., a smartphone). The encoded messages received by the antenna 88 and transceiver 90 are sent to the signal processor 92, which utilizing the selected protocol (e.g., z-wave, internet, or Bluetooth) extracts information from the wireless message. The signal processor 92 then transmits the extracted information to the master board 46 to determine how the electronic lock 10 responds to the received wireless message. The power switch 94 controls power to the transceiver 90 based on when the master board 46 determines that each of the communication boards 22, 24, 26 is to be activated.

Figure 10:
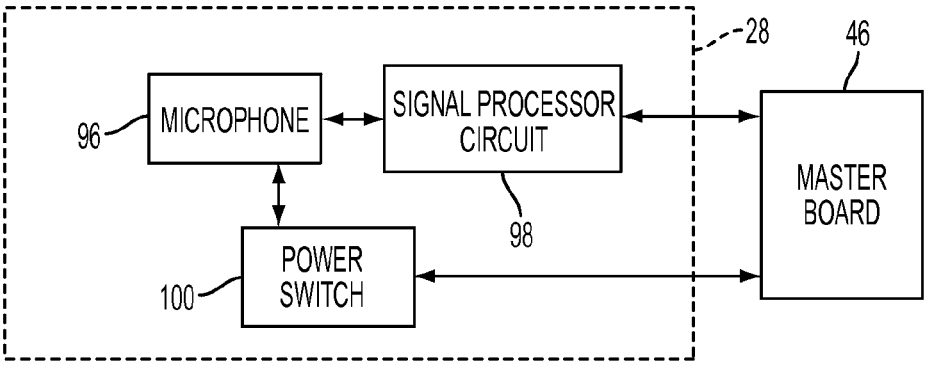
FIG. 10 is a schematic diagram of a microphone board.

The master board 46 can also receive signals from the microphone board 28. As shown in FIG. 10, the microphone board 28 includes a microphone 96, a signal processing circuit 98, and a power switch 100. The power switch 100 enables the microphone board 28 based on when the master board 46 indicates that the microphone board 96 is to be powered. The microphone receives sounds signals from a user, generally a user's voice, and transmits the detected sound signals to the signal processing circuit 98. The signal processing circuit 98 includes an amplifier circuit and an analog to digital converter. The amplifier circuit allows even small sound signals detected by the microphone 96 to be amplified and considered part of the input sound signal. The analog to digital converter 98 digitizes the analog sound signals detected by the microphone 96. The analog to digital converter 98 then transmits the digital signals indicative of the detected sound signals to the master board 46. The master board 46 may perform an authentication action by comparing certain parameters of the detected sound signals to stored voice profiles for authorized users. In other words, the master board 46 then performs voice recognition to determine if the user is an authorized user. The master board 46 can also receive the digitized sound signals and perform an action as requested by the user. For example, if the user says "activate the camera," the master board 46 then activates the camera board 14. In some embodiments, the master board 46 authenticates the user before accepting voice commands. In other embodiments, the master board 46 receives voice commands even if the user has not been authenticated.

Figure 11:
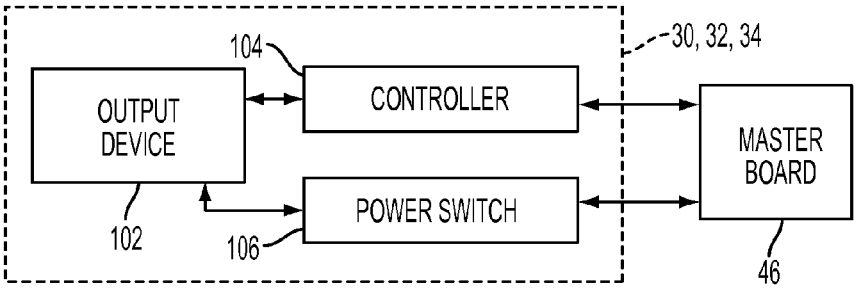
FIG. 11 is a schematic diagram of an output board.

The display board 30, the speaker board 32, and the buzzer board 34 include similar components. These boards 30, 32, 34 will be described together and collectively referred to as the output boards 30, 32, 34. As shown in FIG. 11, the output boards 30, 32, 34 include an output device 102, a controller 104, and a power switch 106. The output device 102 includes a display, a speaker, and a buzzer for the display board 30, the speaker board 32, and the buzzer board 34, respectively. The power switch 106 selectively powers the output device 102 based on when the master board 46 indicates that the output device 102 is to be activated. The power switch 106 may also selectively power the controller 104. The controller 104 communicates with the master board 46 regarding the specific outputs for the output device 102. For example, when the output device 102 is a display, the master board 46 communicates to the controller 104 the message and/or icons that are to be displayed on the display. The controller 104 may then communicate more directly with the output device 102 to determine, for example, which LEDs are to be on, what color, etc. When the output device 102 is a speaker, the controller 104 may include a set of amplifiers to control the volume at which the speaker outputs a sound as determined by the master board 46. When the output device 102 is a buzzer, the controller 104 may determine the frequency of the buzzer and/or the length of time for which the buzzer is activated.

Figure 12:
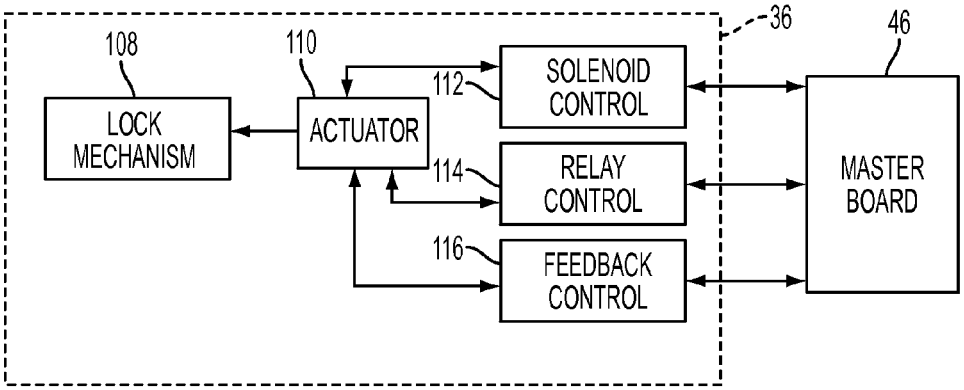
FIG. 12 is a schematic diagram of a motor control board.

The motor control board 36 controls the lock mechanism 108 of the electronic lock 10. As shown in FIG. 12, the motor control board 36 includes the lock mechanism 108, an actuator 110 (e.g., an electric motor, solenoid, etc.), and an actuator control circuit. The actuator control circuit includes a solenoid control 112, a relay control 114, and a feedback control 116. The master board 46 determines when the lock mechanism 108 is to be released to grant access to an authorized user by performing an authentication action and verifying that the user is an authorized user. The master board 46 then communicates with the motor control board 36 to control the motor 110 to release the lock mechanism 108. In particular, the master board 46 communicate with the solenoid control 112, the relay control 114, and the feedback control 116 to operate the motor 110 to release the lock mechanism 108. Together, the solenoid control 112, the relay control 114, and the feedback control 116 determine the operational parameters for the motor 110 such as, for example, the motor speed, applied voltage, turning direction, etc.

The electronic lock 10 also includes the wired communication board 38. The wired communication board 38 includes different connectors to receive compatible connectors and transmit data to the master board 46. For example, in the illustrated embodiment, the wired communication board 38 includes a USB connector, a microUSB connector, etc. The connectors are coupled to the master board 46. The wired communication board 38 may be used to configure various settings of the electronic lock 10, or to transfer information to the electronic lock 10. For example, a USB storage device (e.g., a flashdrive) may be used to input fingerprint scans of authorized users, access codes, patterns, etc. of authorized users. The wired communication board 38 may also be used to export data from the electronic lock 10. For example, the stored access codes for authorized users, the fingerprint scans, etc. may be copied or moved to an external USB storage device, for later transfer to, for example, another electronic lock 10. In the illustrated embodiment, the master board 46 first authenticates a user as an authorized user before allowing data to be imported or exported from the electronic lock 10 to prevent theft of authorization information.

The electronic lock 10 also includes various methods to power the desired secondary boards 12-44 and the master board 46. For example, the electronic lock 10 includes the power over Ethernet board 40 that receives power from an internet connection. The power over Ethernet board 40 includes a receptacle configured to receive a cable with sufficient lines to communicate both data and power. For example, the receptacle may be configured to receive a Cat5 cable. In other embodiments, the receptacle may receive other types of cables.

Figure 13:
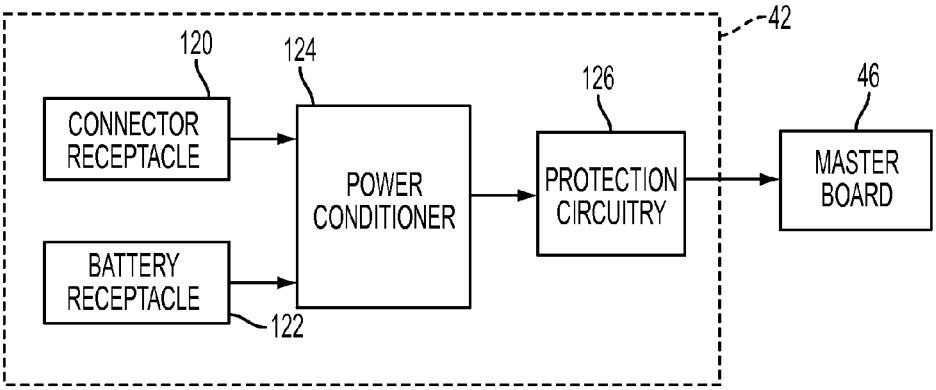
FIG. 13 is a schematic diagram of an external power input board.

As shown in FIG. 13, the external power input board 42 includes a connector receptacle 120, a battery receptacle 122, a power conditioner 124, and power protection circuitry 126. The receptacle 120 is configured to receive a power connector (e.g., a barrel type connector). The battery receptacle 122 is configured to receive a battery, for example, a lithium ion 9V battery. The external power input board 42 then transfers the power received through the receptacle 120 or from the battery receptacle 122 to the power conditioner 124. The power conditioner 124 may be, for example, a DC-to-DC converter that steps down or boosts up the voltage as appropriate based on the power needs of the electronic lock 10. In the illustrated embodiment, the power conditioner 124 is coupled to the master board 46 to transfer power to the master board 46. The master board 46 may then distribute power to the secondary boards 12-44 when each secondary board 12-44 is powered. In other embodiments, the power input board 42 distributes power to the secondary boards 12-44 and supplies power to the master board 46 to power the master board 46. In some embodiments, the power conditioner 124 may also include a filter to obtain a more stable power signal. The power input board 42 also includes protection circuitry 126 that may include a fuse or similar device to prevent the electronic lock 10 to be damaged from power surges or a power malfunction. In some embodiments, the power input board 42 includes only the battery receptacle 122 and does not include the connector receptacle 120. When the battery is low, the battery is removed and a new one is inserted in its place.

Figure 14:
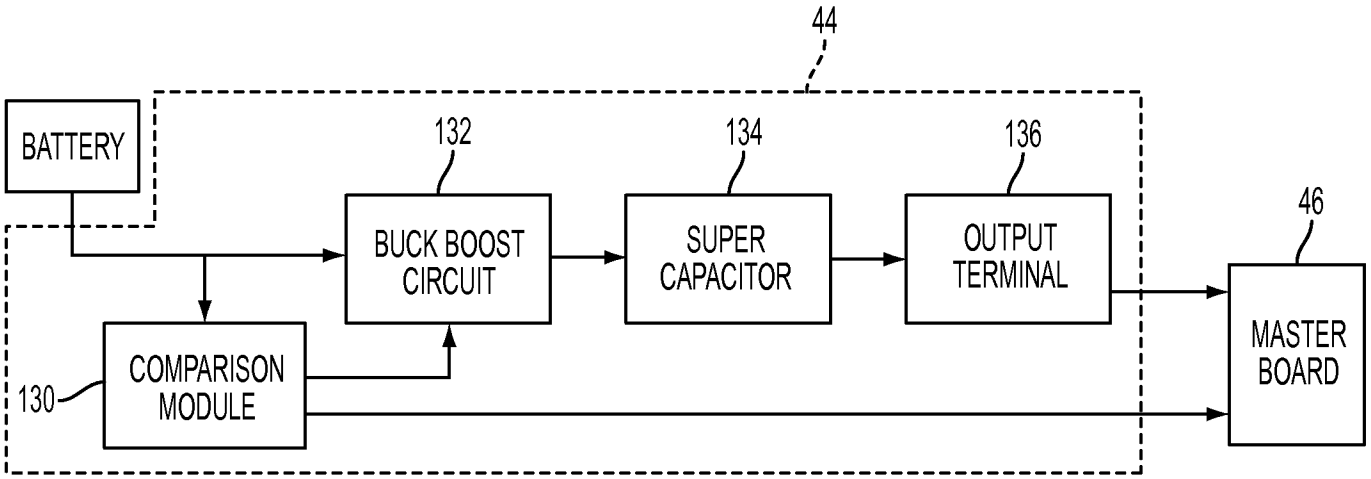
FIG. 14 is a schematic diagram of a super capacitor board.
Figure 15:
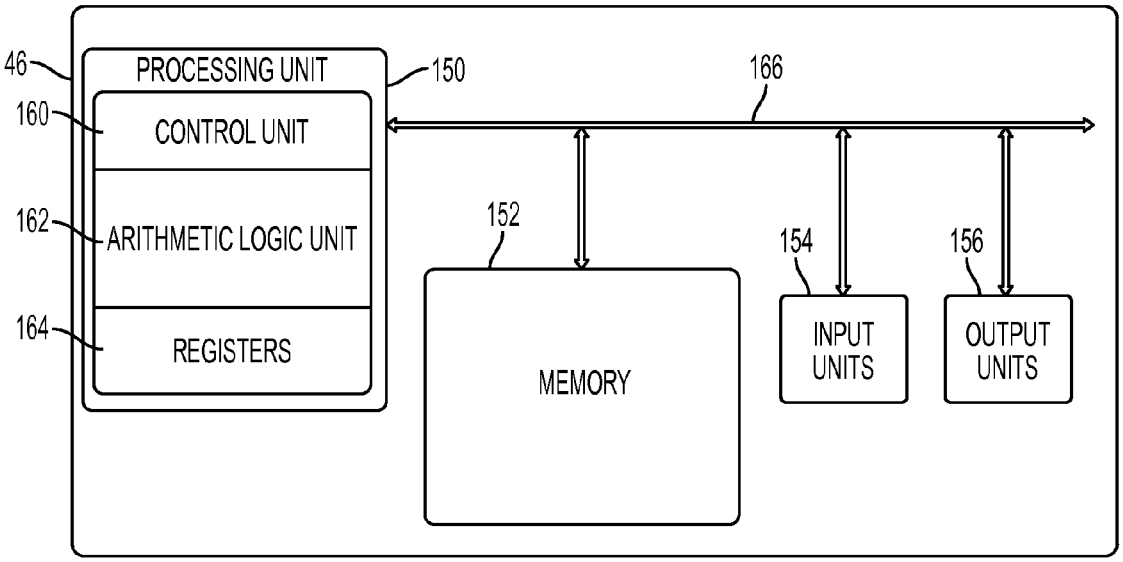
FIG. 15 is a schematic diagram of a master board.

The electronic lock 10 also includes the super capacitor board 44 to provide back-up power for the electronic lock 10 when the battery in the battery receptacle 122 becomes discharged. As shown in FIG. 14, the super capacitor board 44 includes a comparison module 130, a buck-boost circuit 132, a super capacitor 134, and an output terminal 136. The comparison module 130 is electrically coupled to the battery receptacle 122 of the power input board 42 to determine when the battery drops below a predetermined voltage threshold. In the illustrated embodiment, the battery provides approximately 7.0 Volts to the master board 46. The comparison module 130 determines when the battery voltage (i.e., the state of charge of the battery) drops below 4.4 Volts (e.g., the predetermined voltage threshold). Once the battery voltage has dropped below the predetermined voltage, the super capacitor 134 is charged to provide back-up power to the electronic lock 10. The super capacitor receives power from the battery receptacle 122 until fully charged. Then, the super capacitor 134 provides temporary power to the electronic lock 10 such that even when the battery becomes discharged, a user can still, at least momentarily, turn on the electronic lock 10 and gain access to the restricted area. The comparison module 130 may be implemented in hardware using a differentiator circuit, as shown in FIG. 14. In other embodiments, the comparison module 130 may be implemented in software, or a combination of hardware and software. When the comparison module 130 determines that the state of charge of the battery is below the predetermined voltage threshold, the comparison module 130 outputs a control signal to both the buck0boost circuit 132 and to the master board 46. The master board 46 may, for example, provide an indication (e.g., a sound, a displayed message, a flashing LED, etc.) to the user that the battery is low and that the super capacitor 134 is being charged.

Although the battery may not provide enough power to power the electronic lock 10, the battery still continuous to provide electrical power. Therefore, the buck-boost circuit 132 receives power from the battery through the battery receptacle 122 and provides approximately 6V power output to the super capacitor 134. The super capacitor 134 receives the electrical energy from the buck-boost circuit 132 and stores the electrical energy until the super capacitor is fully charge (e.g., reaches its maximum energy storage capacity). Once the super capacitor 134 is fully charged, the super capacitor 134 provides an electrical power output to the master board 46 to power the master board 46 and the secondary boards 12-42. In the illustrated embodiment, the super capacitor 134 is a four microfarad capacitor and charges in approximately 60 seconds and provides a 7V power output. The super capacitor 134, in the illustrated embodiment, provides approximately 350 mA at about 63% efficiency. Because the super capacitor 134 stores a limited amount of energy, the super capacitor 134 only power the electronic lock 10 for a limited time period. In the illustrated embodiment, the super capacitor 134 powers the electronic lock (e.g., the master board 46 and the secondary board 12-42) for approximately 12 seconds. In other embodiments, the period of time during which the electronic lock 10 receives power from the super capacitor 134 varies from for example zero seconds to five minutes. In other embodiments, the period of time for which the super capacitor powers the processor may be different. Therefore, when the electronic lock 10 is powered by the super capacitor 134, the electronic lock 10 operates in an ultra-low power mode designed specifically to minimize energy usage of the electronic lock 10.

The super capacitor board 44 allows the electronic lock 10 to receive power from the battery through the battery receptacle 122 even after the battery is not able (e.g., too low) to provide power directly to the master board 46 and to the secondary boards 12-42. For example, in the illustrated embodiment, the battery provides approximately 6.5V to the electronic lock 10. When the battery drops below the predetermined voltage threshold (e.g., 4.4V), the battery no longer provides power to the master board 46 and the secondary boards 12-42 directly, but the battery can indirectly provide power to the electronic lock 10 through the super capacitor 134. The super capacitor 134 is charged with the remaining voltage of the battery and builds up charge over time. When the super capacitor 134 harvests sufficient power (e.g., 7V), the super capacitor 134 powers the master board 46 and any desired secondary boards 12-42. Because the super capacitor 134 is charged from the battery, which is an already slightly discharged battery, the more discharged the battery (i.e., the lower the state of charge of the battery), the longer it takes for the super capacitor 134 to reach full charge. This delay in the charging of the super capacitor 134 helps indicate to the user that the battery needs to be replaced and/or recharged.

The master board 46 is electrically and/or communicatively connected to the secondary boards 12-44 as shown in FIG. 2. The master board 46 includes combinations of hardware and software that are operable to, among other things, control the lock mechanism 108 of the electronic lock 10 and control operation of the secondary boards 12-44. In some embodiments, the master board 46 includes a plurality of electrical and electronic components that provide power, operational control, and protection to the secondary boards 12-44 and to the components of the master board 46. As shown in FIG. 14, the master board 46 includes, among other things, a processing unit 150 (e.g., a microprocessor, a microcontroller, or another suitable programmable device), a memory 152, input units 154, and output units 156. The input units 154 and the output units 156 allow the master board 46 to communicate with the secondary boards 12-44. The master board 46 can then receive information (e.g., from the keypad board 12) and send information (e.g., to the motor control board 36) to operate the electronic lock 10. The processing unit 150 includes, among other things, a control unit 160, an arithmetic logic unit ("ALU") 162, and a plurality of registers 164 (shown as a group of registers in FIG. 14). The processing unit 150 is implemented using a known computer architecture, such as a modified Harvard architecture, a von Neumann architecture, etc. As shown generally in FIG. 14, a control and/or data bus (e.g., a common bus 166) connects the processing unit 150, the memory 152, the input units 154, and the output units 156.

The memory 152 includes, for example, a program storage area and a data storage area. The program storage area and the data storage area can include combinations of different types of memory, such as read-only memory ("ROM"), random access memory ("RAM"), electrically erasable programmable read-only memory ("EEPROM"), flash memory, a hard disk, an SD card, or other suitable magnetic, optical, physical, or electronic memory devices. The processing unit 150 is connected to the memory 152 and executes software instructions that are stored in a RAM of the memory 152 (e.g., during execution), a ROM of the memory 152 (e.g., on a generally permanent bases), or another non-transitory computer readable medium such as another memory or a disc. Software included in the implementation of the electronic lock 10 can be stored in the memory 152 of the master board 46. The software includes, for example, firmware, one or more applications, program data, filters, rules, one or more program modules, and other executable instructions. The master board 46 is configured to retrieve from memory 152 and execute, among other things, instructions related to the control processes and methods described herein. In other embodiments, the master board 46 include additional, fewer, or different components. In particular, the memory 152 stores information regarding the different operational modes of the electronic lock 10. The memory 152 also stores a configuration file that specifies which secondary boards 12-44 are activated during a particular mode. The configuration file is then associated with the stored mode such that when the master board 46 begins to operate the electronic lock 10 in a specific mode, the configuration file includes information regarding which secondary boards 12-44 are to be activated to operate in that mode.

In the illustrated embodiments, the memory 152 stores a plurality of preset modes from which the user can select (e.g., using the touch LCD 72) an operational mode for the electronic lock 10. In the illustrated embodiments, the user can also program new modes by selecting specific features desired in the electronic lock 10. When a user programs a new mode, the master board 46 determines which secondary boards 12-44 provide the desired features and stores information (e.g., a list of desired features) regarding these secondary boards 12-44 in a configuration file that is associated with the user defined mode. When the user-defined mode is selected, the master board 46 retrieves the configuration file associated with the selected mode and activates the secondary boards 12-44 as indicated by the configuration file. In some embodiments, the master board 46 may store a table that associates a specific mode with its respective configuration file. In other embodiments, the configuration file is labeled with its respective mode. In other embodiments, the master board 46 may associate the configuration file and the mode using a different method.

In the illustrated embodiment, the preset modes for the electronic lock 10 include an active communication mode, a polling mode, a monitoring mode, and the ultra-low power mode. The active communication mode allows a user to remotely open the electronic lock 10 with minimal wait time (i.e., immediately). During the active communication mode, the wireless communication boards 22, 24, 26, the display board 30, the speaker board 32, the motor control board 36, and the power input boards 40-44 are activated. To ensure minimal wait time between the time that the user sends an open command to the electronic lock 10 and the time when the electronic lock 10 actually opens. The wireless communication boards 22, 24, 26 periodically determine whether a wireless communication signal has been received from an external device 2 at short time intervals (e.g., one second). The electronic lock 10 can then receive the remote command from the user soon after (e.g., almost immediately) after the user sends the command. After receiving the remote unlock command from the user, the master board 46 performs a remote authentication action to ensure that the user is an authorized user. In some embodiments, the external device 2 identifies itself when sending the remote unlock command, and the master board 46 determines whether the external device 2 is part of a list of authorized users. After the user has been verified as an authorized user, the master board 46 communicates with the motor control board 36 to release the lock mechanism 108 of the electronic lock 10.

In some embodiments, the electronic lock 10 may output messages to the person waiting to gain access to the restricted area. The electronic lock 10 may, for example, display a message indicating that the master board 46 is validating the remote unlock command from the user. In other embodiments, the electronic lock 10 may emit a sound when the remote unlock command has been verified. Because the wireless communication boards 22, 24, 26 periodically check for received communications, the active communication mode generally has a higher power consumption than other preset modes for the electronic lock 10. The electronic lock 10 operates in the active communication mode when the user instructs the electronic lock 10 to operate in the active communication mode or when the active communication mode as a default mode. The electronic lock 10 exits the active communication mode when the user selects a different mode, or when the state of charge of the battery is too low to support activation and periodic polling of the wireless communication boards 22, 24, 26.

The polling mode is similar to the active communication mode described above since it allows for the user to send a remote unlock command to the electronic lock 10. However, the polling mode places a lower priority on minimal wait time thereby reducing power consumption of the electronic lock 10. In the polling mode, the wireless communication boards 22, 24, 26, the display board 30, the speaker board 32, the motor control board 36, and the power input boards 40-44 are activated. In the polling mode, the wireless communication boards 22, 24, 26 periodically determine whether a wireless communication signal has been received from the external device 2 at longer time intervals (e.g., 5 seconds). Therefore, the electronic lock 10 may not release the lock mechanism 108 as quickly as when the electronic lock 10 operates in the active communication mode. On the other hand, however, the power consumption of the electronic lock 10 when operating in the polling mode is lower than when the electronic lock 10 operates in the active communication mode. The electronic lock 10 operates in the polling mode when the user instructs the electronic lock 10 to operate in the polling mode, or when the user selects the polling mode as the default mode. The electronic lock 10 exits the polling mode when the user selects a different mode, or when the state of charge of the battery is too low to support activation and polling by the wireless communication boards 22, 24, 26. In some embodiments, the active communication mode and the polling mode are combined into one wireless communication mode and the polling time (e.g., how often the wireless communication boards 22, 24, 26 check for wireless communication from the external device 2) can be adjusted by the user.

In the monitoring mode, the electronic lock 10 detects wake up events indicating that a user wishes to gain access to the restricted area. The monitoring mode is a low-power mode for the electronic lock 10 that allows the electronic lock 10 to increase its battery life. In the monitoring mode, the electronic lock 10 minimizes power usage by activating only the secondary boards 15, 16, 22 that allow the master board 46 to detect wake up events. In the illustrated embodiment, the wake up events include detecting motion near the electronic lock 10, detecting touch on an LCD touch screen 72, and/or receiving a z-wave communication message. In the illustrated embodiment, the electronic lock 10 activates the infrared sensor board 15 to enable detection of motion, the outdoor touch LCD board 16 to enable detection of touch input, and the z-wave communication board 22 to enable reception of a z-wave communication message. In other embodiments, the electronic lock 10 can detect more or less wake up events. In other embodiments, the electronic lock 10 can detect different wake up events such as, for example, receiving a user input through the keypad 50, receiving a voice input through the microphone 96, detecting communication through the wired communication board 38, etc. In such embodiments, the electronic lock 10 may energize different secondary boards 12-44 to properly detect different wake up events.

The electronic lock 10 enters the monitoring mode when the user sets the monitoring mode as the default mode. The user may set the default mode to be the monitoring mode to conserve power. In other embodiments, the electronic lock 10 enters the monitoring mode if the electronic lock 10 is inactive (e.g., without user interaction) for a predetermined period of time (e.g., 2 hours). In such embodiments, the monitoring mode is a sleep mode that allows minimal functions of the electronic lock 10 to be available, while also being accessible to enter a different operational mode easily. In other embodiments, the electronic lock 10 automatically enters the monitoring mode when the state of charge of the battery is below a predetermined voltage level. For example, if the electronic lock 10 operates with approximately 8V, the electronic lock 10 may automatically (e.g., without user interaction) enter the monitoring mode when the state of charge of the battery is less than 8.5V. In the illustrated embodiment, the predetermined voltage level at which the monitoring mode is entered is higher than the voltage used by the electronic lock 10. In such embodiments, the electronic lock (e.g., the master board 46) detects that the state of charge of the battery is decreasing and approaching a voltage level at which the battery is not able to completely power the electronic lock 10. Therefore, the electronic lock 10, in an effort to slow the discharge of the battery, automatically enters the monitoring mode and helps prolong the remaining battery life.

The electronic lock 10 exits the monitoring mode after the electronic lock 10 detects the wake up event. After the master board 46 detects a wake up event, the master board 46 enters a different mode to authenticate the user as an authorized user. In some embodiments, the user may set the electronic lock 10 to enter a different mode as soon as the wake up event is detected. In other embodiments, the user may select how to identify him/herself to the electronic lock 10 once the wake up event is detected. From the different mode, the user can be authenticated and gain access to the restricted area.

In the ultra-low power mode, the electronic lock 10 provides the user limited authentication options in an effort to minimize consumption power by the electronic lock 10. During the ultra-low power mode, only the keypad board 12, the biometric authorization board 20, and the super capacitor board 44 are activated. Therefore, the user can either enter an access code or provide his/her fingerprint to be authenticated. In the ultra-low power mode, the electronic lock 10 disables any peripheral components or any other secondary board. For example, speakers, microphones, wireless communication, and other such additional components to the electronic lock 10 are not powered and are thereby disabled. The electronic lock 10 enters the ultra-low power mode when the state of charge of the battery is insufficient to power the secondary boards 12-42 associated with the other operational modes.

The electronic lock 10 enters the ultra-low power mode when the super capacitor 134 begins to provide power to the electronic lock 10. Because the super capacitor 134 only harvests a limited amount of energy, the electronic lock 10 only provides the user with two authentication options: the keypad 50 and the biometric board 20. Once the user is authenticated, the electronic lock 10 returns to the monitoring mode in an effort to continue saving energy. When the battery is replaced or recharged, the electronic lock 10 is again released to enter different operational modes. Until then, the electronic lock 10 operates between the monitoring mode and the ultra-low power mode.

Figure 16:
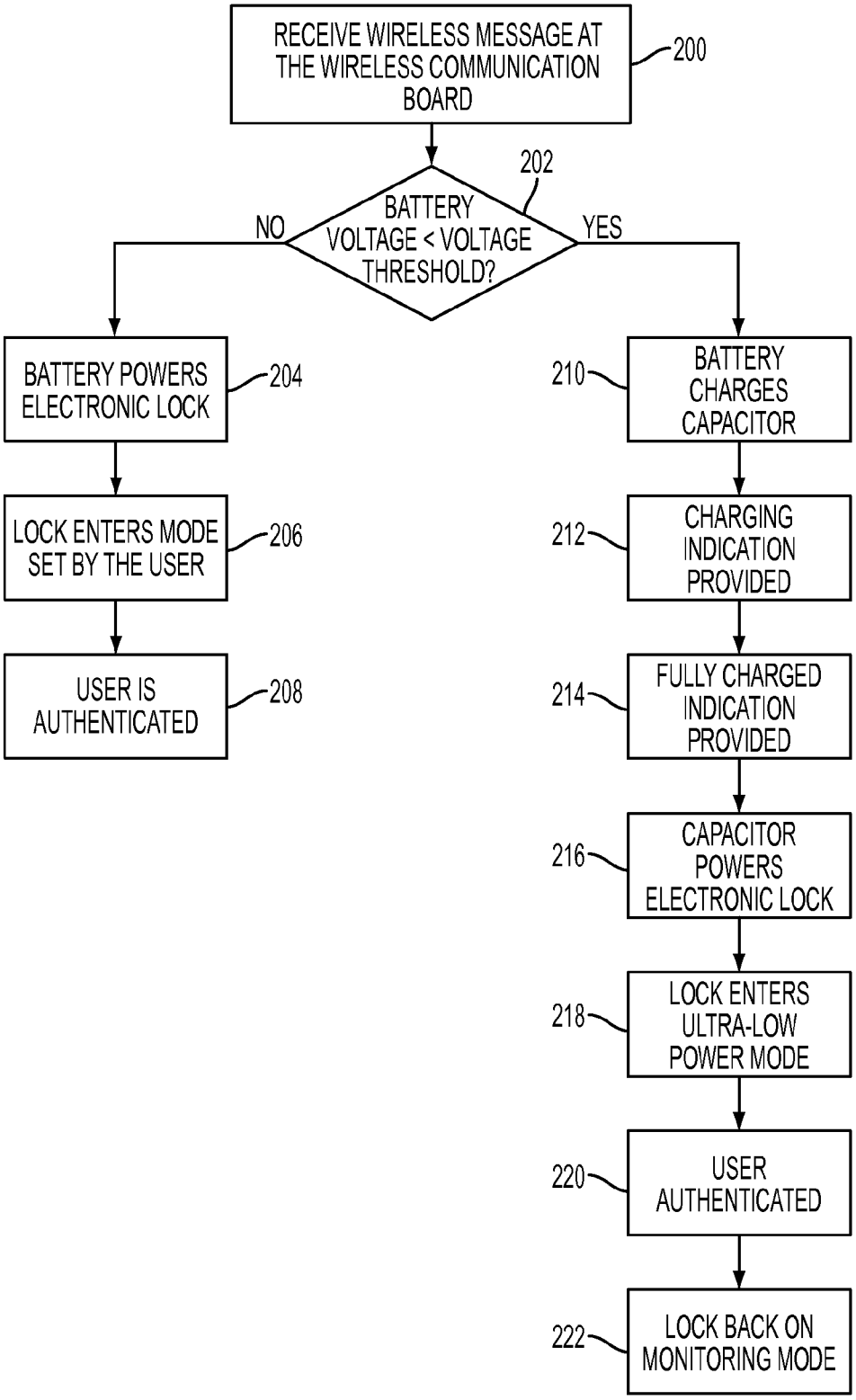
FIG. 16 is a flowchart illustrating a method of operating the electronic lock.

FIG. 16 illustrates an exemplary method of operation for the electronic lock 10 described above. The electronic lock 10 starts in the monitoring mode to conserve battery power and be able to detect wake up events. In the first step 200, the electronic lock 10 detects a wake up event while in the monitoring mode. In the illustrated embodiment, the wake up event includes a wireless message transmission to the wireless communication board 22. After detecting the wake-up event, the super capacitor board 44 determines whether the state of charge of the battery is below the predetermined voltage threshold (step 202). If the state of charge of the battery is above (e.g., not below) the predetermined voltage threshold, the battery provides power to the electronic lock 10 (step 204). The electronic lock 10 then enters a different mode (step 206) based on user selection and authenticates the user (step 208). The mode may be any of the preset modes or a mode programmed by the user. The electronic lock 10 may authenticate the user via any of the available boards by entering the different operational mode. For example, the user may be authenticated via communication with the external device 2, the fingerprint scanner 78, the keypad 50, a voice input, etc.

Referring back to step 202, if the state of charge of the battery is below the predetermined voltage threshold, the battery begins to charge the super capacitor 134 (step 210). As explained above, the charge time for the super capacitor 134 varies according to the remaining charge on the battery. For example, if the remaining charge on the battery is lower, the super capacitor 134 takes longer to charge. If, on the other hand, the state of charge of the battery is just below the predetermined voltage threshold, the super capacitor 134 takes a shorter amount of time to charge. While the super capacitor 134 charges, the electronic lock 10 provides the user an indication that the super capacitor 134 is currently charging (step 212). The indication can be a noise, a vibratory signal, a visual signal, etc. The indication signals to the user that the electronic lock 10 operates on a back-up power system. The indication can serve to remind the user to replace and/or recharge the battery, and also assures the user that the electronic lock 10 has not malfunctioned. Once the super capacitor 134 has fully charged, the super capacitor 134 provides a second indication to the user (step 214) and begins to power the electronic lock 10 (step 216). The second indication may be different than the first indication provided to the user. The second indication signals to the user that the super capacitor 134 (or back up power system) is now powering the electronic lock 10.

While the super capacitor 134 powers the electronic lock 10, the electronic lock 10 enters the ultra-low power mode (step 218). The user is then authenticated via the keypad 50 or the fingerprint scanner 78 (step 220). Once the user has been authenticated, the electronic lock 10 returns to operating in the monitoring mode (step 222). In contrast to step 208 in which the electronic lock 10 may enter any operational mode, when the super capacitor 134 powers the electronic lock 10, the electronic lock 10 remains in the monitoring mode to continue to conserve energy and inhibit the battery from becoming fully discharged.

The electronic lock 10 authenticates the user by determining whether the inputted code, fingerprint, or the associated external device match information stored for an authorized user. If the provided information matches information stored regarding the authorized users, the electronic lock 10 opens and provides access to the restricted area. If, on the other hand, the provided information does not match an authorized user, the electronic lock 10 remains closed.

When the electronic lock 10 enters a different mode as referred to in step 208 of FIG. 16, the electronic lock 10 executes an adaptive power up sequence. The adaptive power up sequence for the electronic lock 10 varies based on the selected mode of operation for the electronic lock 10. Powering up a particular electronic device sometimes requires more energy than simply maintaining the electronic device on. Therefore, in an effort to conserve battery power, the electronic lock 10 powers up only the secondary boards 16-32 indicated in the configuration file associated with the selected mode of operation. By powering up only the boards (e.g., modules) 12-46 that are used in the specific operation mode selected for the electronic lock 10 allows battery power to be conserved and allows for a much faster power up sequence. In some embodiments, the user can specify the power up sequence for the selected mode of operation. In other embodiments, some of the modes for the electronic lock 10 include an already established power up sequence and other modes of the electronic lock 10 can be established or edited by the user.

Thus, the invention provides, among other things, an electronic lock including a super capacitor as a back-up power supply. Various features and advantages of the invention are set forth in the following claims.

What is claimed is:

1. An electronic lock comprising:

a lock mechanism;

an actuator coupled to the lock mechanism and configured to lock and release the lock mechanism;

an actuator control circuit coupled to the actuator;

a battery electrically coupled to the actuator;

a super capacitor electrically coupled to the battery, the super capacitor configured to receive power from the battery when a state of charge of the battery is below a predetermined voltage threshold; and a processor coupled to the actuator, the battery, and the super capacitor, the processor configured to selectively receive power from the battery and the super capacitor, wherein the processor receives power from the super capacitor when the state of charge of the battery is below the predetermined voltage threshold, and provide control signals to the actuator control circuit to control operation of the actuator.

2. The electronic lock of claim 1, further comprising a wireless communication circuit coupled to the processor, the wireless communication circuit configured to send and receive wireless messages from an electronic device.

3. The electronic lock of claim 2, wherein the processor is configured to operate in a first mode, in which the wireless communication circuit is enabled, and operate in a second mode, in which the wireless communication circuit is disabled.

4. The electronic lock of claim 3, wherein the processor operates in the first mode when the processor receives power from the battery, and operates in the second mode when the processor receives power from the super capacitor.

5. The electronic lock of claim 1, wherein the processor is configured to receive power from the super capacitor for a period of time between zero seconds and five minutes.

6. The electronic lock of claim 1, further comprising a first authentication board coupled to the processor and including a keypad, and a second authentication board coupled to the processor and including a biometric scanner, and wherein the processor is configured to receive a data signal from one of the first authentication board and the second authentication board, compare the data signal with authorized information stored in a memory of the electronic lock, and send a control signal to the actuator control circuit indicating to release the lock mechanism when the data signal matches the authorized information stored in the memory of the electronic lock.

7. The electronic lock of claim 1, further comprising a speaker board coupled to the processor, a camera board coupled to the processor, a touch-enabled screen board coupled to the processor, a keypad board coupled to the processor, and a wireless communication board coupled to the processor, wherein the wireless communication is configured to receive wireless messages from an electronic device using a z-wave protocol, and wherein the processor is configured to operate in a monitoring mode, in which the speaker board is disabled, operate in an operational mode, in which the speaker board is enabled, and switch from the monitoring mode to the operational mode based on a data signal received from one of the camera board, the touch-enabled screen board, the keypad board, or the wireless communication board, the data signal indicating a user input.

8. The electronic lock of claim 7, wherein the processor is configured to store a list of features available to a user when the processor operates in the operational mode, and wherein the processor is configured to power only secondary boards associated with the list of features when the processor switches from the monitoring mode to the operational mode.

9. The electronic lock of claim 7, wherein the processor is configured to automatically operate in the monitoring mode when the state of charge of the battery is below a second predetermined voltage threshold.

10. A method of operating an electronic lock including a processor, a battery, and a super capacitor, the method comprising the steps of:

receiving power from the battery when a state of charge of the battery is above a predetermined voltage threshold, providing power to the super capacitor from the battery when the state of charge of the battery is below the predetermined voltage threshold, receiving power from the super capacitor when the state of charge of the battery is below the predetermined voltage threshold, and sending a control signal to a actuator control circuit coupled to a actuator, the actuator coupled to a lock mechanism of the electronic lock, wherein the control signal causes the actuator to release the lock mechanism.

11. The method of claim 10, further comprising sending and receiving wireless messages from an electronic device using a wireless communication circuit coupled to the processor.

12. The method of claim 11, further comprising operating in a first mode in which the wireless communication circuit is enabled, and operating in a second mode in which the wireless communication circuit is disabled.

13. The method of claim 12, wherein operating in the first mode includes operating in the first mode when receiving power from the battery, and wherein operating in the second mode includes operating in the second mode when receiving power from the super capacitor.

14. The method of claim 10, wherein receiving power from the super capacitor includes receiving power for a period of time between zero seconds and five minutes.

15. The method of claim 10, further comprising selectively receiving a data signal from one of a first authentication board coupled to the processor and a second authentication board coupled to the processor, wherein the first authentication board includes a keypad and the second authentication board includes a biometric scanner, comparing the data signal to authorized information stored in a memory of the electronic lock, and wherein sending the control signal to the actuator control circuit includes sending the control signal when the data signal matches the authorized information.

16. The method of claim 10, further comprising operating in a monitoring mode in which at least a peripheral component of the electronic lock is disabled, operating in an awake mode in which the peripheral component is enabled, and switching from the monitoring mode to the awake mode based on a data signal received from one of a group including a camera board coupled to the processor, a touch-enabled screen board coupled to the processor, a keypad board coupled to the processor, and a wireless communication board coupled to the processor, wherein the data signal is indicative of a user input.

17. The method of claim 16, further comprising storing a list of features available to a user when the electronic lock operates in the awake mode, and wherein switching from the monitoring mode to the awake mode includes providing power only to circuits associated with the list of features when the processor switches from the monitoring mode to the awake mode.

18. The method of claim 16, wherein operating in the monitoring mode includes automatically operating in the monitoring mode when the state of charge of the battery is below a second predetermined voltage threshold.

19. The method of claim 18, wherein the second predetermined voltage threshold is higher than the predetermined voltage threshold.

* * * * *